US007329448B2

(12) United States Patent
Cunningham

(10) Patent No.: US 7,329,448 B2
(45) Date of Patent: Feb. 12, 2008

(54) ADHESIVE PADS FOR FOOTWEAR

(76) Inventor: Kathleen Cunningham, 3250 N. Oak Park Ave., Chicago, IL (US) 60634

( * ) Notice: Subject to any disclaimer, the term of this patent is extended or adjusted under 35 U.S.C. 154(b) by 9 days.

(21) Appl. No.: 11/082,631

(22) Filed: Mar. 17, 2005

(65) Prior Publication Data

US 2006/0210751 A1 Sep. 21, 2006

(51) Int. Cl.

| | |
|---|---|
| ***B32B 9/00*** | (2006.01) |
| ***B32B 33/00*** | (2006.01) |
| ***A61F 13/00*** | (2006.01) |
| ***A61F 13/06*** | (2006.01) |
| ***A61L 15/00*** | (2006.01) |

(52) U.S. Cl. ..... 428/40.1; 428/42.2; 428/343; 602/41; 602/52; 602/57; 206/440; 128/889; 128/892; 128/893; 128/894

(58) Field of Classification Search ..... 428/40.1, 428/42.2, 42.3; 602/52, 41, 54, 57, 61, 65, 602/66; 206/820, 440, 460; 128/892, 893, 128/889, 894

See application file for complete search history.

(56) References Cited

U.S. PATENT DOCUMENTS

| | | | | |
|---|---|---|---|---|
| 2,001,862 | A * | 5/1935 | Battey | 606/204.35 |
| 2,969,062 | A * | 1/1961 | Landau | 128/894 |
| 4,210,245 | A * | 7/1980 | Dodge | 206/440 |
| 4,832,644 | A | 5/1989 | Roberts | |
| 5,914,166 | A | 6/1999 | Le | |
| 6,362,387 | B1 | 3/2002 | Carlson et al. | |
| 6,684,442 | B1 | 2/2004 | Parker et al. | |
| 2002/0128580 | A1 | 9/2002 | Carlson et al. | |

OTHER PUBLICATIONS

Scott Foot Care, Soins Pour Les Pieds, Moleskin Velours de Coton, Product, 1 pg.
Dr. Scholls, Suede Heel Grips, Helps prevent blisters and improve fit in new and old shoes, 1 pair for all shoes, Product, 1 pg.
Band-Aid, Advanced Healing Blister Block, Product, 1 pg.
No. 5079, Professional ProFoot, Soft Strips, Pre-Cut Moleskin Comfort Strips, Product, 1 pg.
Pietsch, Ingo, Taccosling, Tacco Sling, Made in Germany, 3 pgs.

* cited by examiner

*Primary Examiner*—Rena Dye
(74) *Attorney, Agent, or Firm*—Beem Patent Law Firm

(57) ABSTRACT

An adhesive pad kit for footwear has at least two pairs of thin adhesive backed pads in which the pads in one pair have one predetermined shape wherein the length is at least twice as long as the width, and the pads in the second pair have a different predetermined shape. The kit can have pads that are generally rectangular. The kit can also have one pair of pads that are generally rectangular and the other pair of pads that are curved segments. The adhesive pads can be made of moleskin material. An adhesive pad kit for footwear may have at least two pairs of thin adhesive backed pads in which the pads in one pair have one predetermined color and the pads in the second pair have a different color.

18 Claims, 2 Drawing Sheets

ADHESIVE PADS FOR FOOTWEAR

BACKGROUND

1. Field of the Invention

This invention is related generally to adhesive pads for affixing to footwear, such as shoes or sandals.

2. Description of the Prior Art

Shoes come in standard sizes, but they usually do not fit perfectly against the wearer's feet. Poor shoe fit may cause the wearer much discomfort. Shoe size primarily corresponds to the length of the foot. The size may also correspond to the ball width of the foot. But there are other important feet measurements that most standard shoe sizes do not account for, including: heel width, heel-to-ball length, and instep girth. Some shoes may offer choices of discrete widths, but there will still be shoe wearers who cannot find their comfortable fit within discrete sizes. Shoes corresponding to the wearer's standard size often may be ill-fitting, being too loose or too tight, or both. Straps on shoes often may not fit appropriately over the foot. The straps may be too tight and pinch the foot, or they may be too loose and rub against the foot. Efforts to adjust the fit of a shoe may detract from the appearance of the shoe. If material is affixed to the shoe to adjust the fit, the color of the material may not match the color of the shoe.

Available products offer limited solutions to poor fit and discomfort. One product that is designed for poor fitting shoes is the TACCO sling. TACCO slings are designed to be affixed to the heel strap of women's sling back shoes to keep the heel strap from slipping. The TACCO slings are sold as a pair of gray leather strips having the dimension of 1 cm by 7½ cm. TACCO slings may not have the color and style to match many shoes, thus detracting from the shoe's overall appearance. The TACCO slings may not be appropriate for other areas of the shoe, like the shoe throat or the heel portion of the sock lining.

Dr. Scholl's Suede Heel Grips are designed to affix to the heel backing to keep the heel snug in the shoe. The Heel Grips are designed and shaped only for the heel backing and may not conveniently be used in other problem areas on the shoe. The Heel Grips are designed for close-heeled shoes and are not designed to offer solutions for open-heeled shoes.

Poor fitting shoes may cause tender spots on the foot such as corns, calluses, and blisters. Moleskin may be affixed to the foot for the purpose of cushioning the tender spots on the foot or for preventing them. However, moleskin applied to the feet may fall off due to perspiration and require reapplication. Moreover, moleskin applied directly to the feet may show through sandals or other shoes with straps.

Some shoes may be provided with orthotic supports to align or support the foot. Orthotic pads can prevent, correct or accommodate foot deformities or weaknesses. Orthotics are typically molded out of plastic or thick pads, and designed to provide structural support for the foot. Orthotics are typically custom-made to fit and support the patient's foot.

What is needed is a convenient product that provides options to ensure a comfortable shoe fit and minimize rubbing and pinching of the foot by the surface of the shoe.

SUMMARY

In one aspect of the invention, an adhesive pad kit for footwear includes at least two pairs of thin adhesive backed pads, wherein one pair has one predetermined shape having a length at least twice as long as the width, and the other pair has a different predetermined shape from that of the first pair. In one embodiment of the invention, the pads may be made from moleskin. In another aspect, two pairs of pads may be generally rectangular. In still another aspect, one pair may be generally rectangular and another pair may be curved segments. In yet another aspect, one pair may be generally disk-shaped and another pair may be generally rectangular.

In another aspect, an adhesive pad kit for footwear includes two pairs of thin adhesive backed pads, wherein each pad in one pair has a predetermined color and each pad in another pair has a different predetermined color. In yet another aspect, a set of adhesive pad kits for footwear includes one kit with a predetermined color and another kit with a different predetermined color.

DETAILED DESCRIPTION OF THE INVENTION

As shown in FIGS. 1-2, 4-8, adhesive pad kits 10*a-g* for footwear have at least two pairs of thin adhesive backed pads 80 in which one pair of pads has one predetermined shape wherein the length is at least twice as long as the width, and the second pair of pads has a different predetermined shape. Adhesive pad kits 10*a-g* for footwear may have precut pads 80 made from a cushioning material adhered to backing 20. The cushioning material may be treated to form a plurality of shaped pads 80, wherein each one of shaped pads 80 may be selectively removed from backing 20.

Figure 1:
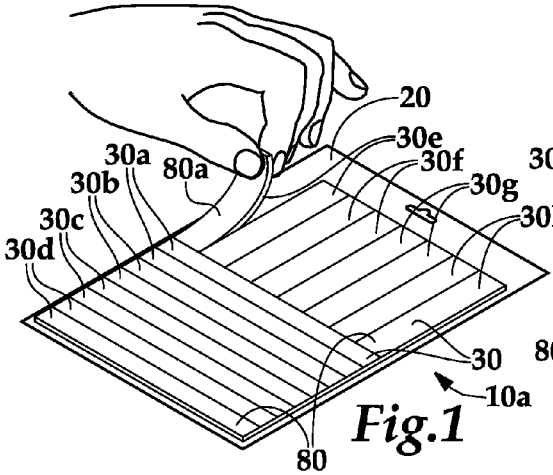
FIG. 1 is a perspective view of one embodiment of an adhesive pad kit having rectangular elements of two different sizes, with one rectangular element shown being removed from the backing.
Figure 2:
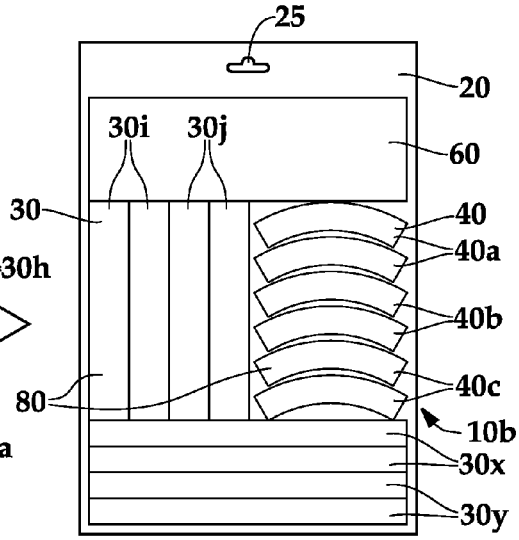
FIG. 2 is a top view of an alternative embodiment of an adhesive pad kit having rectangular elements, curved segment elements and two expanses.

As seen in FIG. 1, the cushioning material may be affixed to backing 20. Backing 20 may comprise plastic or paper (which may be coated), or both. Backing 20 may be treated as is known in the art to allow the cushioning material to be easily adhered to, and removed from, backing 20. It is preferred that there is a common backing 20 for each kit, although backing 20 may be separate for each shaped pad 80. The means of affixing cushioning material to backing 20 is by pressure sensitive adhesive on cushioning material. Backing 20 may have a means to allow stores to easily display kits 10*a-g*, such as an eyelet 25, as shown in FIG. 2.

The cushioning material of pads 80 may be fabric, preferably of cotton material, and more preferably of moleskin. In another embodiment, the cushioning material may be leather. In yet another embodiment, the cushioning material may be polyester. The cushioning material may be quite thin, preferably between about 1/32 inch and 3/16 inch, more preferably between about 1/32 inch and about 1/8 inch, and still more preferably about 1/16 inch.

Figure 4:
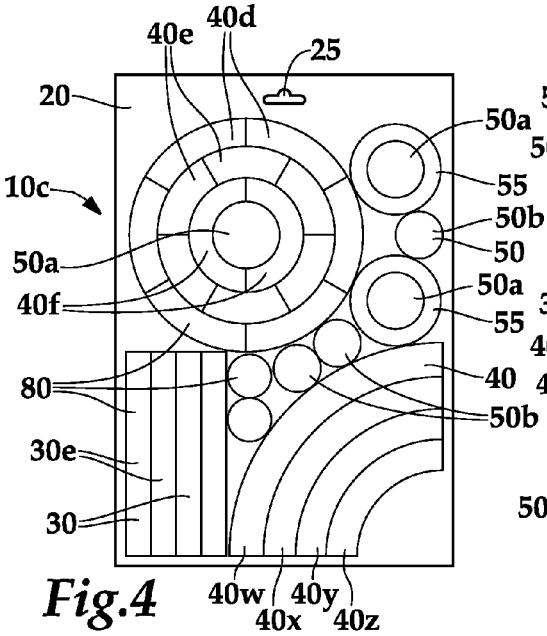
FIG. 4 is a top view of an alternative embodiment of an adhesive pad kit having disk-shaped elements, rectangular elements, annular elements and curved segment elements.

As seen in FIGS. 1, 2, and 4-8, the cushioning material may be treated to form predetermined sizes and shapes. In a preferred embodiment, the cushioning material is precut, and more preferably, the cushioning material is die cut, to form predetermined sizes and shapes. Preferably, the cushioning material forms predetermined shaped pads 80. The predetermined shaped pads 80 may be generally rectangular elements 30, curved segment elements 40, or generally disk-shaped elements 50. Each one of generally rectangular elements 30 and curved segment elements 40 may be substantially continuous, that is, without holes punched therein. Other predetermined shapes may be squares, ovals or triangles. Predetermined shaped pads 80 may be generally annular elements 55, as shown in FIG. 4. Precut material in predetermined shapes and sizes may be applied to an area on the shoe to relieve pressure and/or rubbing against the skin.

Generally rectangular elements 30 and curved segment elements 40 may have lengths between about 4 inches and between about 1 inch and widths between about 1/2 inch and about 3/16 inch. Rectangular elements 30*a-m*, 30*p* and 30*r* shown in kits 10*a-g* are all rectangular elements 30. All rectangular elements 30 and curved segment elements 40 and disk-shaped elements are shaped pads 80. Selected sizes for generally rectangular elements 30 and curved segment elements 40 are shown as follows in Table 1.

TABLE 1

| Width (inches) | Length (inches) |
|---|---|
| ~3/16 | ~1 |
| ~3/16 | ~2 |
| ~3/16 | ~3 |
| ~3/16 | ~4 |
| ~1/4 | ~1 |
| ~1/4 | ~2 |
| ~1/4 | ~3 |
| ~1/4 | ~4 |
| ~5/16 | ~1 |
| ~5/16 | ~2 |
| ~5/16 | ~3 |
| ~5/16 | ~4 |
| ~3/8 | ~1 |
| ~3/8 | ~2 |
| ~3/8 | ~3 |
| ~3/8 | ~4 |
| ~7/16 | ~1 |
| ~7/16 | ~2 |
| ~7/16 | ~3 |
| ~7/16 | ~4 |
| ~1/2 | ~1 |
| ~1/2 | ~2 |
| ~1/2 | ~3 |
| ~1/2 | ~4 |

These lengths and widths are not exhaustive, but only illustrative. The selected lengths may include any length within half an inch. A kit may include at least two pairs of shaped pads 80 in sizes selected from Table 1 or other sizes as may be desired. One pair of shaped pads 80 may be of one size selected from Table 1, and a second pair may have shaped pads 80 having a different selected size from that of the first pair. Rectangular elements 30 may have rounded corners.

Curved segment elements 40 may be the outer portion of circular sectors, see FIGS. 2, 4, 5 and 7. The lengths of curved segment elements 40 are measured from the middle of one end to the middle of the other end, following the curve. The angles of the circular sectors from which curved segment elements 40 are taken may, for example, be about 30 degrees, about 60 degrees, about 90 degrees, about 105 degrees, and about 180 degrees. Alternatively, curved segment elements 40 may be portions of an elliptical sector. The angles of elliptical sectors 40*h* and *i*, and 40*j* and *k* may be measured by the angle of the circular sector that most closely approximates the elliptical sector. A kit may include a pair of curved segment elements 40 wherein elements 40 are the outer portion of circular sectors having one of the angles listed above, and one of the selected sizes from Table 1. A kit may have two pairs of curved segment elements 40, wherein elements 40 of a first pair have a different dimension from elements 40 of a second pair.

Generally disk-shaped elements 50 may have a diameter of between about 1/4 inch and about 1 inch. Selected sizes of disk-shaped elements 50 may have, for example, a diameter of: about 1/4 inch, about 5/16 inch, about 3/8 inch, about 7/16 inch, and about 1/2 inch.

Generally annular elements 55 may have a diameter of between about 1/4 inch and about 1 inch. Generally annular elements 55 may have a diameter of about 1/4 inch, about 5/16 inch, about 3/8 inch, about 7/16 inch, about 1/2 inch, and about 3/4 inch.

Expanse 60, as seen in FIG. 2, may be incorporated on backing 20 to allow the user to cut a customized shape and/or size as needed for application to the shoe. More than one expanse 60 may be incorporated on backing 20. Expanse 60 may preferably have a length of between about 1 and about 5 inches, more preferably between about 2 and about 4 inches, and still more preferably about 3 inches. Expanse 60 may preferably have a width of between about 1/2 inch and about 2 inches, more preferably between about 3/4 inch and about 1 1/2 inches, and still more preferably about 1 inch. The wearer may cut, as with pads 80, a customized shape and size into expanse 60 and remove the cushioning material from backing 20 and apply the customized shape and size to the shoe. Expanse 60 may be easy to cut with a pair of scissors, nail clippers and/or other cutting tools.

Cushioning material may be dyed to be different colors such as generally black, generally white, generally beige, generally red, generally gold, generally silver, generally blue, generally purple, generally yellow, and generally green. Differently colored cushioning material may help shaped pads 80 blend in with the color of the shoe to which shaped pads 80 are affixed. Since shoes are about style as well as comfort and function, colored precut cushioning material will not detract from the style of the shoe by ruining the color scheme of the shoe. A kit may include pads of any combination of the above colors. A kit may have one pair of pads 80 of one predetermined color, and a second pair of pads 80 having a different color from the first pair. Alternatively, a kit may have pads 80 of the same color. A set of kits having pairs of rectangular elements 30, wherein one pair has a length at least twice as long as the width, may have one kit of one predetermined color and a second kit of a second predetermined color.

Kits 10*a-g* provide a shoe wearer with the option of buying a relatively inexpensive kit to solve the problem of elegant looking, but ill-fitting shoes. The shoe wearer can quickly and easily solve the any problems with discomfort by buying a kit in accordance with the invention in a checkout line display. Alternatively, a young woman on her way to the prom wearing an ill-fitting pair of shoes can stop by a local convenience store and buy a ready-to-use kit off the shelf with little or no need for tools. This prevents the need to go to a shoe repair shop, which has more limited hours than a convenience store and may be less easy to locate.

As shown in FIG. 1, the user may remove the desired shaped pad 80*a* by lifting a corner of shaped pad 80 and separating cushioning material from backing 20. The general process may be the same for other kits 10*b-g*. Preferably, separating one shaped pad 80 from backing 20 will not separate adjacent precut elements from backing 20. Shaped pads 80 allow easy and fast application of precut cushioning material to problem areas on the shoe.

A kit comprising one or more backing sheets of precut shapes, sizes and/or colors provides the shoe wearer with a variety of options to remedy the problem of an uncomfortable shoe fit. The user can simply locate the kit and peel off the desired pad 80 with the desired precut shape and color and apply it to the shoe. Applying shaped pad 80 to a shoe allows the wearer to apply the cushioning material just once to a shoe. In contrast, if the wearer applies the cushioning material to the foot, the cushioning material may have to be reapplied every time the shoe is worn, thus wasting time and cushioning material. Shaped pads 80 can be easily cut, if desired, by a pair of nail clippers or a pair of scissors.

Embodiments of different kits 10*a-g* are shown in FIGS. 1, 2, and 4-8. A kit may include at least two pads of different shapes. Preferably there are two or more pairs of matching pads, with at least two pairs being of different shapes. Shape of shaped pads 80 is defined by the size and geometry of the pad.

Kit 10*a* shown in FIG. 1 may be most helpful to someone wearing sandals because shaped pads 80 may be applied to the straps. Preferably kit 10*a* includes at least two pairs of rectangular elements 30. Kit 10*a* may have one pair of one size and a second pair of a second size. Kit 10*a* may have four pairs of one size and four pairs of another size.

Continuing with FIG. 1, a shaped pad 80 comprising any of pairs of rectangular elements 30*a-d* may have a length at least twice as long as the width, and more preferably have a length at least five times as long as the width. In kit 10*a* rectangular elements 30*a-d* may have the dimensions of about ¼ inch by about 3 inches. Shaped pad 80 comprising any of pairs of rectangular elements 30*e-h* may have a length at least three times as long as the width, and more preferably a length at least four times as long as the width. Rectangular elements 30*e* may have the dimensions of about ⅜ inch by about 2 inches.

In one embodiment, kit 10*a* may be of one color. In one embodiment as shown in FIG. 1, kit 10*a* may have rectangular elements 30*a* being of one predetermined color, rectangular elements 30*b* being of a different predetermined color, rectangular elements 30*c* being of yet a different predetermined color, and rectangular elements 30*d* being of yet a different predetermined color from rectangular elements 30*a-c*. In one embodiment, elements 30*a* may be black, elements 30*b* may be white, elements 30*c* may be beige, and elements 30*d* may be blue. Rectangular elements 30*e* may be the same predetermined color as 30*a*, rectangular elements 30*f* may be the same predetermined color as 30*b*, and rectangular elements 30*g* may be the same predetermined color as 30*c*. Rectangular elements 30*h* may be of one of the colors of 30*a-d* or may be of a different predetermined color.

As shown in FIG. 2, kit 10*b* may include at least two pads of different shapes. Preferably there may be at least two pairs, each pair being of different shapes. One pair may be rectangular elements 30*i* and one pair may be curved segment elements 40*a*. Optionally, one or two expanses 60 may be included in kit 10. Kit 10*b*, as shown in FIG. 2 in one embodiment, may have rectangular elements 30, curved segment elements 40, and expanses 60. Kit 10*b* may be particularly helpful to someone experiencing heel pain or discomfort where the foot flexes.

Continuing with FIG. 2 and kit 10*b*, curved segment elements 40*a-c* may be applied to the shoe throat or heel backing. Rectangular elements 30*i-j* may be applied to the heel backing. Rectangular elements 30*i* and 30*j* may have dimensions of about ⅜ inch by about 1½ inches. Rectangular elements 30*i* may have a predetermined color different from that of rectangular elements 30*j*. Rectangular elements 30*x* and 30*y* each may have a length dimension greater than about five times its width dimension. Curved segment elements 40 may have a length at least two times as long as the width, and more preferably have a length at least three times as long as the width. Curved segment elements 40*a-c* may have angles less than about 180 degrees. Curved segment elements 40*a-c* may have dimensions of about ¼ inch by about 2 inches, and an angle of between about 50 degrees and about 70 degrees, preferably of about 60 degrees. Kit 10*b* may have shaped pads 80 all of one color. In one embodiment, curved segment elements 40*a* may have a predetermined color, and curved segment elements 40*b* may have a different color from curved segment elements 40*a*, and curved segment elements 40*c* may have still a different color from both curved segment elements 40*a* and 40*b*.

Continuing with FIG. 2 and kit 10*b*, expanses 60 may have dimensions of about 1 inch by about 3 inches. Preferably, expanse 60 should be at least twice as wide as any rectangular element 30. Expanse 60*a* may have a predetermined color and expanse 60*b* may have a different predetermined color from expanse 60*a*.

Figure 3:
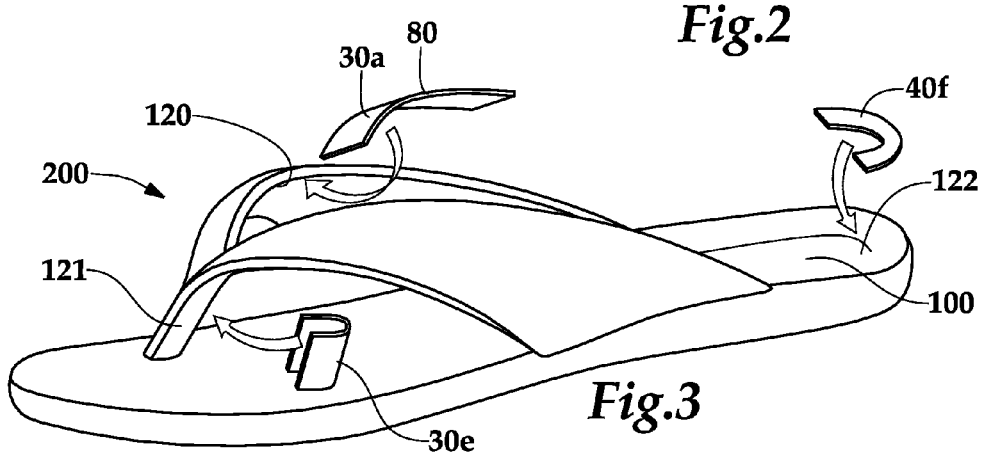
FIG. 3 is a perspective view of a thong sandal, showing where shaped pads may be applied to the underside of the straps and to the heel portion of the sock lining.

Shaped pad 80 may be applied to any area of the shoe that may come in contact with the foot. As shown in FIG. 3, rectangular elements 30*a* and 30*e* of FIG. 1 may be placed on thong sandal 200 to prevent shoe strap 120 from rubbing on the skin of the wearer's foot. Shaped pad 80 may also prevent shoe strap 120 from pinching the foot. Cushioning material may space shoe strap 120 from the foot and keep the strap material from irritating the skin. When shaped pad 80 is placed on sock lining 100, the cushioning material may provide traction so the foot will not easily slip against sock lining 100. As seen in FIG. 3, rectangular element 30*a* may be placed on the underside of strap 120. Rectangular element 30*e* may be affixed to toe strap 121. Curved segment elements 40*f* of FIG. 4 may be placed on the underside of curved straps 120 or on other curved locations, such as the heel portion 122 of sock lining 100.

Kit 10*c*, shown in FIG. 4, has rectangular elements 30*e*, disk-shaped elements 50*a* and 50*b*, annular elements 55, and curved segment elements 40*d-f*, 40*w-z*. Kit 10*c* offers the shoe wearer many small predetermined pieces in different sizes. Kit 10*c* may include a pair of rectangular elements 30*e*, a pair of annular elements 55, a pair of disk-shaped elements 50*a*, and a pair of curved segment elements 40*e*. Optionally, kit 10*c* may also include rectangular elements 30 that are unpaired, disk-shaped elements 50 that are unpaired, or curved segment elements 40 that are unpaired. Annular element 55 may be applied on the shoe to help cushion the foot against corns and calluses, or other foot afflictions which cause discomfort when pressed against the surface of a shoe. Preferably, the length of rectangular elements 30*e* may be at least three times as long as the width. Rectangular elements 30 in kit 10*c* may be any one of the selected sizes from Table 1. In one embodiment, the dimensions of rectangular elements 30*e* may be ⅜ inch by about 2 inches.

Continuing with FIG. 4, kit 10*c* may have two differently shaped disk-shaped elements, 50*a* and 50*b*. There may be a pair of disk-shaped elements 50*a* of one predetermined size, and a second pair of disk-shaped elements 50*b* of a different predetermined size. Disk-shaped elements 50*a* may be about 7⁄16 inch in diameter and disk-shaped elements 50*b* may be about 5⁄16 inch in diameter. There may be several different shapes for curved segment elements 40*d-f*. Curved segment elements 40*d* may have an angle of about 30 degrees and a length of about 3 inches. Curved segment elements 40*e* may have an angle of about 30 degrees and a length of about 2 inches. Curved segment elements 40*f* may have an angle of about 180 degrees and a length of about 3 inches. Curved segment elements 40*w-z* may have an angle of about 90 degrees and a length of between about 1 inch and about 4 inches. Curved segment element 40*w* may have a length of about 4 inches. Curved segment element 40*x* may have a length of about three inches. Curved segment element 40*y* may have a length of about 2 inches. Curved segment element 40*z* may have a length of about 1 inch. Kit 10*c* may have shaped pads 80 one color and different shaped pads 80 of another color.

Figure 5:
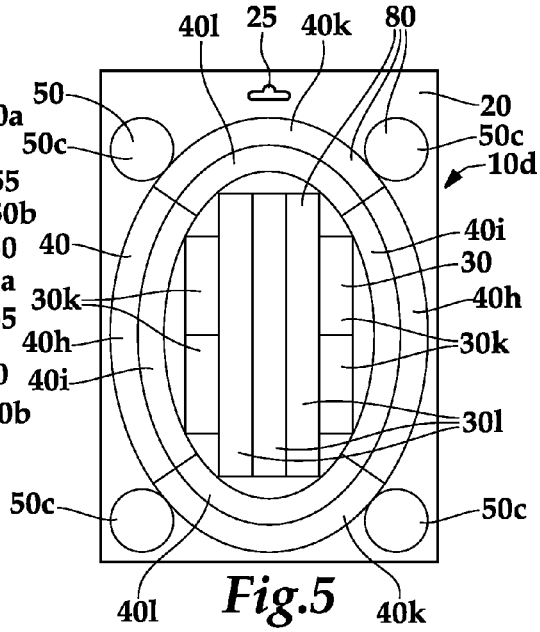
FIG. 5 is a top view of an alternative embodiment of an adhesive pad kit having disk-shaped elements, rectangular elements, and curved elements, with each shaped pad having a matching shaped pad.

Kit 10*d*, as shown in FIG. 5, has rectangular elements 30*k* and 30*l* and curved segment elements 40*h* and 40*i*, and 40*k*, in addition to four disk-shaped elements 50*c*. Kit 10*d* may include at least a pair of curved segment elements 40 and a pair of disk-shaped elements 50*c*. This kit may be particularly helpful to someone wearing shoes with curved straps. Disk-shaped elements 50*c* may have a diameter of about ⅜ inch. Rectangular elements 30*k* may have dimensions of about ¼ inch by about ¾ inch. Rectangular elements 30*l* may have dimensions of about ¼ inch by about 1¼ inches. Preferably each of rectangular elements 30*k* and 30*l* may have a length at least four times as long as its width. Curved segment elements 40*h* and 40*i* may have an angle of about 90 degrees and elements 40*i* may have a length of about 3½ inches and elements 40*h* may have a length of about 4 inches. Curved segment elements 40*k-l* may have an angle of about 105 degrees and elements 401 may have a length of about 2 inches and elements 40*k* may have a length of about 3 inches.

Figure 8:
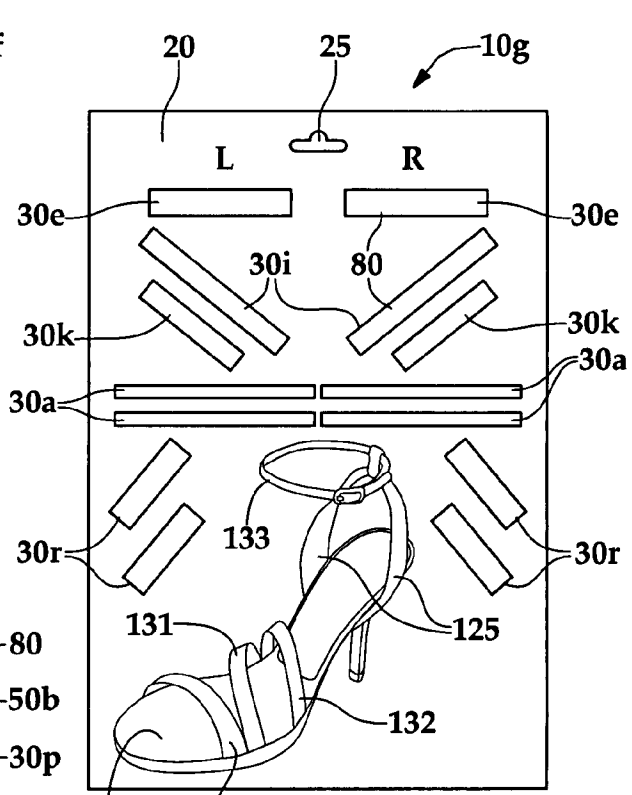
FIG. 8 is a top view of an alternative embodiment of an adhesive pad kit having an outline of a women's dress shoe and having two sets of adhesive pads affixed on the backing in positions to suggest their placement on the shoe.
Figure 7:
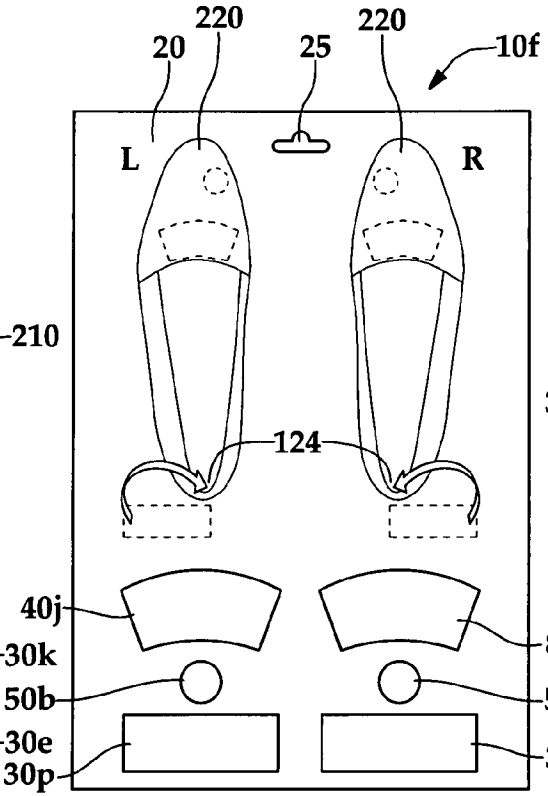
FIG. 7 is a top view of an alternative embodiment of an adhesive pad kit having three pairs of adhesive pads, a close-toed and close-heeled shoe depicted in schematic outline on the backing, with schematic depictions to suggest actual placement of the pads on the shoes.
Figure 6:
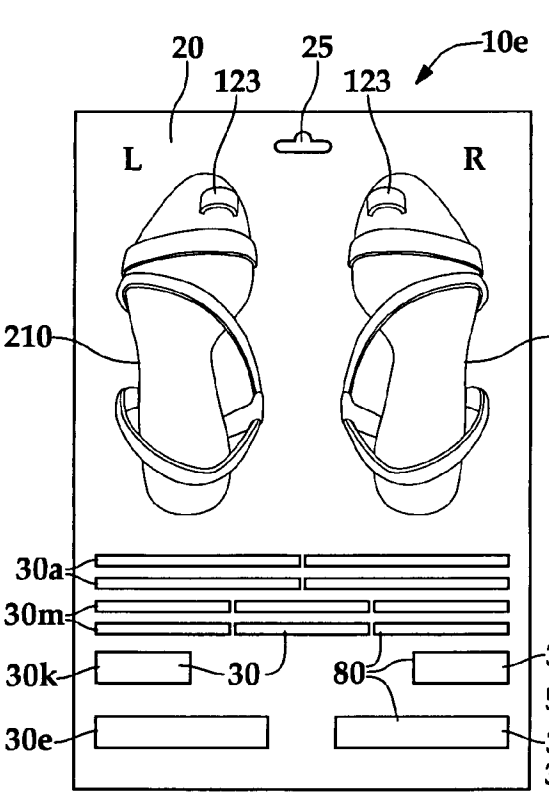
FIG. 6 is a top view of an alternative embodiment of an adhesive pad kit having two sets of adhesive pads cut to be affixed to a pair of sandals similar to the schematic depiction on the backing.

FIGS. 6-8 show kits 10*e-g* with shoe schematics 210, 220, and 230 depicted on backing 20. Shaped pads 80 may be positioned on backing 20 to suggest where shaped pads 80 may be applied to the shoe. Arrows may point to an outline of a shoe to suggest where shaped pads may be placed. Different kits 10*a-g* may be developed for different styles of shoes.

FIG. 6 shows an embodiment of kit 10*e* with sandal pair schematic 210 shown on backing 20. Schematic 210 shows the style of footwear for which shaped pads 80 in kit 10*e* are designed. Kit 10*e* may include at least two pairs of rectangular elements 30, each pair being of a different width. Kit 10*e* may also include at least two pairs of rectangular elements 30, each pair having a different length. Rectangular elements 30 may be affixed to backing 20 below the outline of the sandals and rectangular elements 30 may correspond with a strap on the style of the sandal shown by schematic 210. Rectangular elements 30*a* having dimensions of about ¼ inch by about 3 inches may be placed on any strap of the sandal that goes around the arch or around the heel. Rectangular elements 30*m*, having dimensions of 3⁄16 inch by about 2 inches, may be placed on any foot or heel strap. Rectangular element 30*k* may be placed on toe strap 123. Rectangular element 30*e*, having dimensions of ⅜ inch by about 2 inches, provides more coverage under straps 120 than rectangular elements 30*m*.

FIG. 7 shows an embodiment of kit 10*f* with schematic 220 of a pair of women's enclosed shoes on backing 20 and some schematic pads to show where shaped pads 80 should be applied on schematic 220. Kit 10*f* may also have schematic pads with arrows pointing to the heel backing 124. Kit 10*f* may include one pair of rectangular shaped elements 30*p* and one pair of curved segment elements 40*j*. Kit 10*f* may also include disk-shaped element 50*b*. The dimensions of the pair of rectangular elements 30*p* may be about ½ inch by about 3 inches. The dimensions of the pair of curved segment element 40*j* preferably may have a width of between about ½ inch and 1 inch and may have a length of between about 1½ inch and about 3 inches, and may have an angle of about 55 degrees. Curved segment elements 40*j* may have a length to width ratio of between two and one. In one embodiment the pair of curved segment elements 40*j* may have a width of about 1 inch and a length of about 2 inches. Preferably two sets of shaped pads 80 may be contained in kit 10*f*, one set for each shoe. Optionally, two spare sets may be enclosed in kit 10*f* (not shown), one spare set per shoe.

As shown in FIG. 8, kit 10*g* is shown in FIG. 8 including an outline of a woman's dress shoe shown as schematic 230. Two sets of rectangular elements 30 may be positioned on backing 20 to suggest where rectangular elements 30 may be affixed to the dress shoe. Each set of pads 80 may be affixed to either the left or right shoe of a pair of shoes similar to the shoe shown in schematic 230. There may be at least three different pairs of rectangular elements in kit 10*g*. In one embodiment, there are five different pairs of rectangular elements in kit 10*g*. Text such as "toe strap," "foot strap," and "ankle strap" (not shown) may be printed on backing 20 next to the corresponding shaped pads 80 to better instruct the shoe wearer where to affix shaped pads 80. Pads 80 may be placed on backing in a position and an angle to suggest the look of straps on a shoe like that shown in schematic 230. As shown in FIG. 6-8, an "L" and an "R" may be printed on backing 20 to show that the set of shaped pads 80 under "L" is for the left shoe and the set under "R" is for the right shoe.

Continuing with FIG. 8, rectangular elements 30*e* may be positioned on backing 20 to indicate application under toe strap 130. Rectangular elements 30*i* may be positioned to indicate application under foot strap 131. Rectangular elements 30*k* may be positioned to indicate application under foot strap 132. Rectangular elements 30*a* may be positioned to indicate application under ankle strap 133. Rectangular elements 30*r*, having dimensions ⅜ inch by about 1¾ inch, may be positioned to indicate application under straps 125.

In summary, an adhesive pad kit for footwear includes two pairs of thin adhesive-backed pads 80. One pair of pads 80 has a predetermined shape, wherein the length is at least twice as long as the width, and the second pair of pads 80 has a different predetermined shape. Both pairs of pads 80 may have a predetermined shape wherein the length is at least twice as long as the width. Both pairs of pads may be generally rectangular. One pair of pads 80 may be generally rectangular and the other pair of pads may be curved segments. One pair of pads 80 may be disk-shaped and the other pair of pads 80 may be generally rectangular. As shown in FIG. 2, 10*b* may have an adhesive backed expanse 60 having an area of at least about three square inches with a length of at least two inches long. Kits 10*a-g* may have pads 80 made out of moleskin.

An adhesive pad kit 10 for footwear has two pairs of thin adhesive backed pads 80, wherein each pad in the first pair has a predetermined color, and each pad in the second pair has a different predetermined color. A set of adhesive pad kits for footwear has a first kit with a predetermined color and a second kit with a different predetermined color.

While the foregoing written description of the invention enables one of ordinary skill to make and use what is considered presently to be the best mode thereof, those of ordinary skill will understand and appreciate the existence of variations, combinations, and equivalents of the specific exemplary embodiments thereof. The invention is therefore to be limited not by the exemplary embodiments herein, but by all embodiments within the scope and spirit of the appended claims.

I claim:

1. An adhesive pad kit for footwear comprising:

a schematic having an indication of footwear; and at least two pairs of thin adhesive backed pads;

wherein said indication depicts an operative location for said pad on said footwear.

2. An adhesive pad kit for footwear comprising:

a schematic having an indication of footwear; and two pairs of thin adhesive backed pads, wherein each pad in first pair has a first predetermined shape having a length and width, wherein said length is at least twice as long as said width, and wherein each pad in second pair has a second predetermined shape different from said first predetermined shape;

wherein said indication depicts an operative location for said pad on said footwear.

3. A kit according to claim 2, wherein second said pair has predetermined shape having a length and a width, wherein both said pairs have said lengths at least twice as long as said widths.

4. A kit according to claim 2, wherein each pad in both of said two pairs is generally rectangular.

5. A kit according to claim 2, wherein each pad in said first pair is generally rectangular and each pad in said second pair is a curved segment.

6. A kit according to claim 2, wherein each pad in said first pair is generally disk-shaped and each pad in said second pair is generally rectangular.

7. A kit according to claim 2, further comprising an expanse being at least about two inches long and at least one inch wide.

8. A kit according to claim 2, wherein said pads comprises moleskin.

9. A kit according to claim 2, wherein each pad in first pair has a predetermined color, and each pad in second pair has a different predetermined color.

10. A kit according to claim 2, wherein said first pair has said lengths at least four times as long as said widths.

11. A kit according to claim 2, wherein said first pair has widths of about one quarter inch.

12. A kit according to claim 2, wherein said first pair has widths of about three sixteenths of an inch.

13. A kit according to claim 2, wherein said pads are mounted on a backing.

14. A kit according to claim 13, wherein said schematic is on said backing.

15. A kit according to claim 2, wherein said pad when placed on said operative location on said footwear is not visible when said footwear is on a wearer's foot.

16. A kit according to claim 2, wherein said footwear is a sandal.

17. A kit according to claim 16, wherein said footwear is a thong sandal.

18. A kit according to claim 2, wherein said footwear is a dress shoe.

* * * * *